US005826930A

United States Patent [19]

Whitehead et al.

[11] Patent Number: 5,826,930

[45] Date of Patent: Oct. 27, 1998

[54] CHILD'S SNOW REMOVAL TOOL

[75] Inventors: Stephen P. Whitehead, Elgin; Lyle Rosine, Aurora, both of Ill.

[73] Assignee: Suncast Corporation, Batavia, Ill.

[21] Appl. No.: 726,982

[22] Filed: Oct. 7, 1996

[51] Int. Cl.[6] ..... E01H 5/02

[52] U.S. Cl. ..... 294/54.5; 294/57

[58] Field of Search ..... 294/49, 54.5, 55–59; 16/110 R, 111 R, 114 R, 116 R, 119, 125; 37/241, 265, 268, 278, 284, 285; D8/10, 300, 303

[56] References Cited

U.S. PATENT DOCUMENTS

| | | | |
|---|---|---|---|
| D. 213,630 | 3/1969 | Hoxie et al. . | |
| D. 214,662 | 7/1969 | Portz | D8/10 |
| D. 257,210 | 10/1980 | Bonnes | 294/54.5 X |
| D. 267,468 | 1/1983 | Simms | 294/54.5 |
| D. 269,490 | 6/1983 | Germain | D8/1 |
| D. 284,733 | 7/1986 | Hozumi | D8/10 |
| D. 291,863 | 9/1987 | Kolonia | D8/10 |
| D. 296,410 | 6/1988 | Abbott | 294/54.5 X |
| D. 306,962 | 4/1990 | Schuele | D8/13 |
| D. 328,553 | 8/1992 | Norton et al. | 294/54.5 |
| D. 331,652 | 12/1992 | Wu | D34/27 |
| D. 350,166 | 8/1994 | Kino | D21/120 |
| D. 360,564 | 7/1995 | Tisbo et al. | 294/49 |
| D. 363,653 | 10/1995 | Tisbo et al. | 294/49 |
| 366,099 | 7/1887 | Hinchman | 294/56 |
| D. 384,559 | 10/1997 | Tisbo et al. | D8/10 |
| D. 384,866 | 10/1997 | Tisbo et al. | D8/10 |
| D. 385,160 | 10/1997 | Tisbo et al. | D8/10 |
| 678,373 | 7/1901 | Blaser . | |
| 864,338 | 8/1907 | Schertzer . | |
| 930,660 | 8/1909 | Gifford | 294/54.5 |
| 964,453 | 7/1910 | Robarge . | |
| 967,270 | 8/1910 | Tiedt | 294/54.5 X |
| 1,042,352 | 10/1912 | Kohler | 294/54.5 |
| 1,260,276 | 3/1918 | Miller | 294/54.5 |
| 1,435,061 | 11/1922 | Halsey . | |
| 1,839,285 | 1/1932 | Winkie . | |
| 1,931,349 | 10/1933 | Habig | 97/227 |
| 3,119,596 | 1/1964 | Pratt | 254/131.5 |
| 3,177,026 | 4/1965 | Cowan | 294/54.5 |
| 3,680,641 | 8/1972 | Hein | 172/371 |
| 4,149,744 | 4/1979 | Bonnes | 294/54.5 |
| 4,247,141 | 1/1981 | Grint | 294/49 |
| 4,280,727 | 7/1981 | Germain | 294/54.5 |
| 4,538,847 | 9/1985 | Lapshansky | 294/51 |
| 4,655,494 | 4/1987 | Eads et al. | 294/49 |
| 4,690,447 | 9/1987 | Adams | 294/57 |
| 4,848,073 | 7/1989 | Germain et al. | 56/400.17 |
| 4,878,704 | 11/1989 | Jacanin, Jr. et al. | 294/54.5 |
| 4,991,324 | 2/1991 | Fine et al. | 294/54.5 X |
| 4,993,768 | 2/1991 | Ewen | 294/51 |
| 5,228,734 | 7/1993 | Pollastro | 294/54.5 |
| 5,419,600 | 5/1995 | Tisbo et al. | 294/54.5 |
| 5,435,063 | 7/1995 | Russo | 30/164.5 |

FOREIGN PATENT DOCUMENTS

| | | | |
|---|---|---|---|
| 234243 | 12/1959 | Australia . | |
| 2285163 | 4/1976 | France | 294/49 |
| 641210 | 8/1933 | Germany . | |
| 687817 | 1/1940 | Germany . | |
| 369590 | 3/1939 | Italy . | |
| 1009947 | 11/1965 | United Kingdom . | |
| 1173714 | 12/1969 | United Kingdom . | |
| 1424565 | 2/1976 | United Kingdom . | |
| 2063142 | 6/1981 | United Kingdom | 294/49 |

*Primary Examiner*—Johnny D. Cherry
*Attorney, Agent, or Firm*—Welsh & Katz, Ltd.

[57] ABSTRACT

A child's snow tool is provided for children to easily shovel and lift snow. The lightweight child's snow tool has a flexible plastic handle assembly and snow blade. Desirably, the handle assembly has a special ribbed child's handgrip to further enhance gripping of the child's snow tool.

9 Claims, 3 Drawing Sheets

CHILD'S SNOW REMOVAL TOOL

BACKGROUND OF THE INVENTION

This invention pertains to snow tools and, more particularly, to manual snow shovels.

Handheld portable snow tools, typically referred to as manual snow tools, are useful to remove snow, ice and slush from sidewalks and driveways. Over the years, various types of manual snow tools have been developed, such as snow shovels, pushers and scrapers. Typically, snow shovels have a generally flat blade with a very slight curvature. Snow shovels are useful to shovel, lift, raise and throw light snow away from the sidewalk, stairs or driveway. Snow pushers have a rounded or curved blade. Snow pushers are useful to push heavy or deep snow and slush away from sidewalks and drivers. Scrapers can have a straight blade. Scrapers are useful to scrape, cut and chop ice from sidewalks and driveways. Smaller scrapers are useful to scrape ice from vehicle windows and windshields.

Different amounts of effort are often required to remove the snow from sidewalks, driveways and pavements, depending on the depth, temperature, fluffiness, amounts of slush, water, ice and texture of the snow to be removed. Sometimes, children become overburdened and frustrated by the weight and bulkiness of a regular snow shovel when removing snow. Various snow shovels have been produced especially for children to help shovel and remove snow from sidewalks, stairs and driveways.

In the past, children snow shovels were constructed with a wooden handle. Children snow shovels with a wooden handle, however, are usually heavy and cumbersome for children to use. Furthermore, children's snow shovels with wooden handles are very uncomfortable and awkward for many children to shovel, lift and throw snow. Also, lifting heavy snow with a standard wooden handle snow shovel may cause back injuries and sometimes heart problems for some children.

In an effort to improve the ease of use and decrease the weight of snow tools, some snow shovels have been made with aluminum handles and/or handgrips. Aluminum handles and handgrips can be very cold as well as slippery and difficult to hold when wet, such as when it snows or sleets.

Children's snow shovels have also been fabricated with steel or iron blades. Children snow shovel with steel and iron blades are usually too heavy and difficult for children to use. In a further effort to decrease weight, children's snow shovels have been constructed with aluminum blades. Children's snow shovels with aluminum blades can still be too heavy and cumbersome for many children to use.

In modem times, part of the snow tools have been fabricated of plastic. Early snow shovels with plastic blades were somewhat flimsy and did not wear well.

It is, therefore, desirable to develop an improved child's snow shovel which overcomes most, if not all, of the preceding problems.

SUMMARY OF THE INVENTION

An improved child's snow tool comprising a child's snow shovel is provided which is comfortable, lighter and easier to use for most children than heavy conventional snow shovels. Advantageously, the compact child's snow shovel is fun, simple to maneuver, and easy to lift light snow. The portable light weight snow shovel can efficiently remove snow from sidewalks, driveways, curbs, and outdoor stairways (exterior stairs). Desirably, the attractive child's snow shovel is safe, tough, durable, reliable and economical. The child's snow shovel is also smaller than the standard snow shovel used by adults. Preferably, the child's snow shovel is taller than waist high of a child but shorter than waist high of an average man or woman.

The child's snow tool has a special plastic handgrip, handle and snow blade which provide an environmentally friendly product. Furthermore, the child's snow tool is more weather resistant than standard wooden handle shovels.

To this end, the child's snow tool comprises a handle assembly and snow blade, which are of a compact size for use by children. The light weight handle assembly includes a plastic handle, which is operatively connected to the snow blade, and a handgrip, which is operatively connected to the handle. The handle is preferably formed without heavy material, such as: wood, steel, iron, aluminum, or other metal. The handle can be: a flexible annular plastic shank, a hollow plastic shaft, or an extruded plastic tube fabricated of an impact-resistant plastic, such as polyvinyl chloride (PVC), polypropylene or polyethylene.

The snow blade for the child's snow tool can comprise a flexible light weight snow blade of impact-resistant plastic to shovel, push or lift snow. In the preferred form, the blade is a plastic shovel blade or plastic scoop with ridges which enhance shoveling and create a snowplow effect.

In the preferred form, the handgrip comprises a plastic generally D-shaped child's handgrip with a central access opening to comfortably receive a child's hand. Preferably, the opening of the child's handgrip spans a width more than five fingers of a child's hand but is less than five fingers of an average adult man or woman. The handgrip can have a convex crossbar to receive a child's fingers and flared sides which can be integrally connected to the crossbar. The flared sides can have a general H-shaped cross-sectional configuration to enhance gripping of the child's handgrip. The crossbar can have downwardly depending flanges, crossbar ribs, side ribs and/or corner ribs to further enhance gripping of the snow tool by children.

A more detailed explanation of the invention is provided in the following description and appended claims taken in conjunction with the accompanying claims.

DETAILED DESCRIPTION OF THE PREFERRED EMBODIMENT

Figure 1:
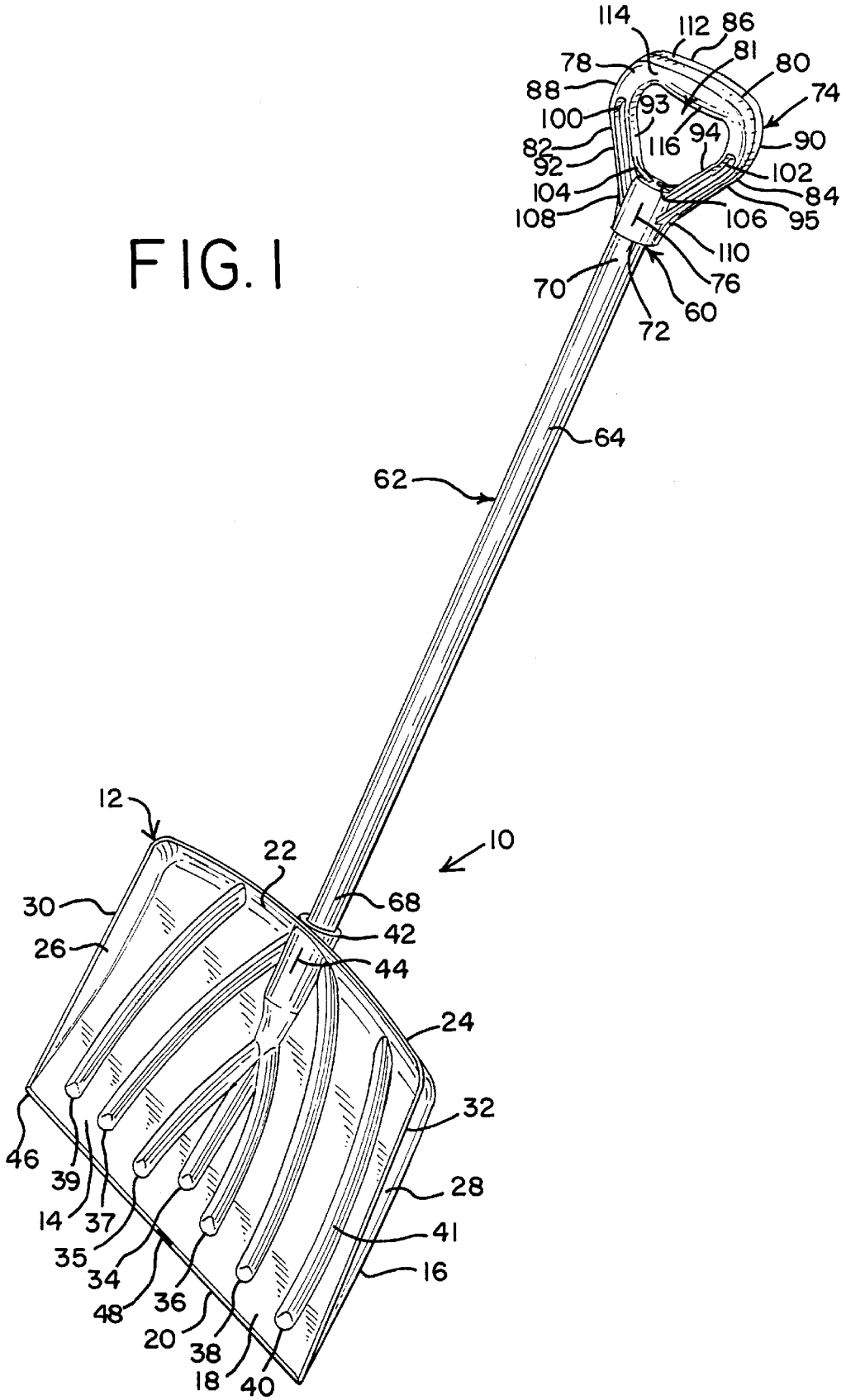
FIG. 1 is a perspective view of a child's snow shovel in accordance with principles of the present invention.

A hand held, manual, portable, child's snow tool 10 (FIG. 1) comprising a child's snow shovel, which is also referred to as a children's snow shovel or a kid's snow shovel, is provided for use by children to manually push, shovel, lift, throw and remove snow from pavements, such as sidewalks and driveways, wooden exterior stairways, concrete stairs, and curbs. The attractive child's snow shovel is molded of flexible, resilient, impact-resistant plastic. Desirably, the compact is light weight, fun and easy for children to lift, maneuver and use.

Figure 2:
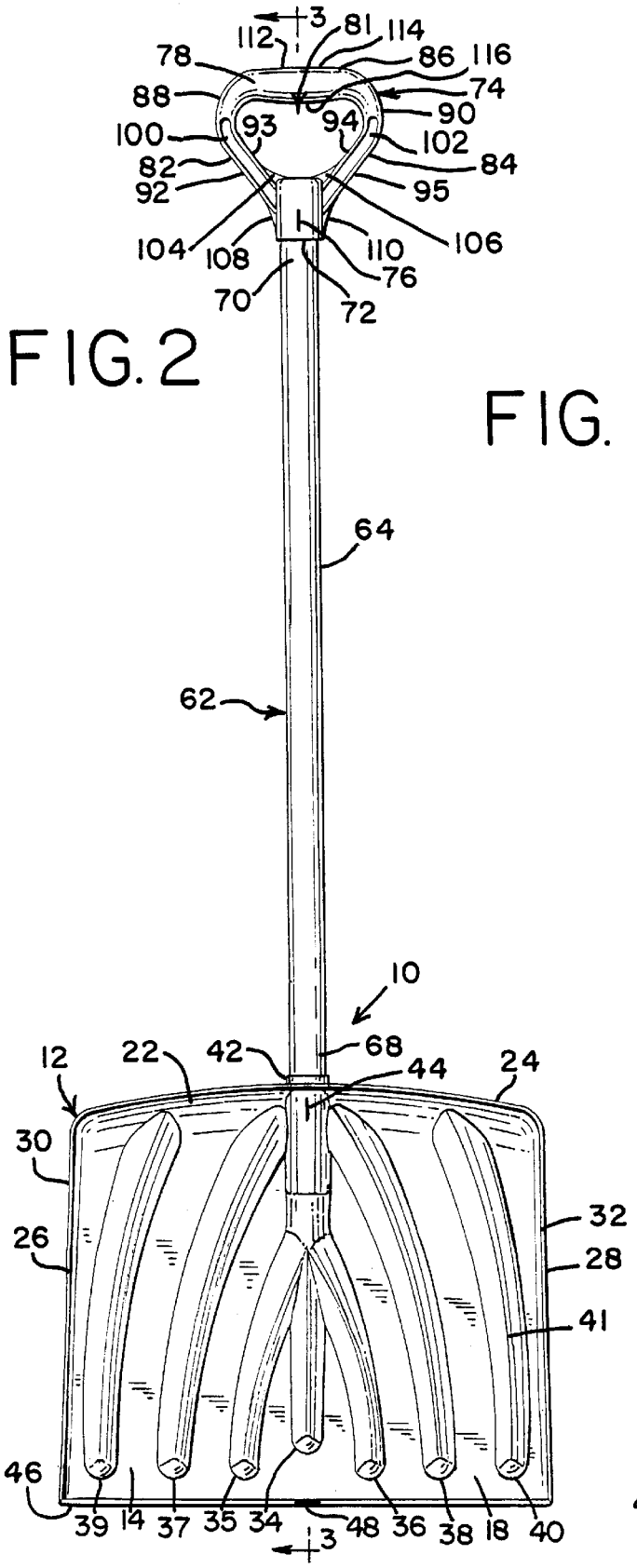
FIG. 2 is a front view of the child's snow shovel.

The snow tool has a generally flat snow shovel blade 12 with a slight curvature that provides a child's snow blade. The child's snow blade 12 is fabricated of impact-resistant plastic, such as polyethylene, polypropylene or graphite-impregnated plastic. The blade has a concave, arcuate, front blade surface 14 (FIGS. 1–3) to push, engage, pickup and lift snow and has a convex back (rear) blade surface 16 (FIGS. 3–6) which supports the front surface. The concave front surface of the blade has a depth of curvature which is shallower, flatter and less round than a conventional snow pusher (pusher blade) and has a radius of curvature which is greater than a conventional pusher (pusher blade) so that the front blade surface of the snow tool can effectively and easily shovel, pickup, lift and throw snow. Child's snow blades have been successfully constructed by applicants with a size of about 9.75"×12" and a radius of curvature slight greater than 17.5".

The child's snow blade has a lower portion 18 (FIGS. 1 and 2) providing a leading edge or front edge 20 and has an upper portion 22 providing a trailing edge or back edge 24. The child's snow blade also has sidewalls 26 and 28 which extend between and are integrally connected to the upper and lower portions of the blade. The sidewalls have generally straight, flat and planar upper edges 30 and 32. The sidewalls help contain, scoop and collect the snow on the curved front blade surface during shoveling and lifting of the child's snow tool.

The child's snow blade further has inverted generally V-shaped bifurcated ribs or ridges 34–40 (FIGS. 1 and 2) which are also referred to as reinforced ribs or curved reinforcement ribs. The inverted V-shaped ridges comprising the ribs of the blade project integrally outwardly (forwardly) of the front blade surface and extend between the lower and upper portions of the blade to enhance the structural strength and integrity of the child's snow blade. The blade's ribs are generally V-shaped as viewed from the back surface of the blade. Preferably, the ribs include curved flared ribs 35–40 which converge laterally inwardly away from the blade's sidewalls and toward the axis of the handle and centerline of the blade in a direction towards the blade's upper portion. The blade's ribs facilitate shoveling and channeling of the snow towards the back edge of the upper portion of the blade's front surface. The blade's ribs also help prevent the channeled snow from falling off the leading edge of the blade. Desirably, the blade's angled ribs provide snowplow ribs which throw and push more snow forward creating a snowplow effect.

The ribs of the child's snow blade include: a center rib 34, inboard ribs 35 and 36, intermediate ribs 37 and 38, and outboard ribs 39 and 40. The ribs can have rounded apexes 41. The inboard ribs converge towards and are integrally connected to an intermediate portion of the blade's center rib. The intermediate ribs are spaced between the inboard and outboard ribs and converge towards and are integrally connected to the upper portion of the center rib adjacent the back edge of the blade's front surface. The outboard ribs are spaced between the sidewalls and the intermediate ribs and curve inwardly towards the back edge of the blade's front surface. The center rib extends along the centerline of the blade and is in alignment with the axis of the handle (handle assembly) of the child's snow tool. The ribs 35–40 are also concave and curved from the front towards the back surface with a concave rib profile 41 (FIG. 3) having a radius of curvature less than the front surface. Child's snow blades have been successfully constructed by applicants with a concave rib profile having a radius of curvature of about 15.35" to the rounded apex of the ribs.

In the child's snow tool, the upper portion of the center rib is deeper than the lower portion of the center rib and forms a socket 42, which provides a coupler or shaft coupling, to snugly receive the lower end of the handle. The socket (coupler) of the child's snow blade extends integrally downwardly from the blade's back surface. The socket (coupler) of the child's snow blade also extends above the upper portion and trailing edge of the snow blade. Metal or wire staples 44 and 45 (FIGS. 1–4) or other fasteners can be used to securely staple, fasten and connect the coupler of the blade to the handle of the child's snow tool.

The leading edge of the lower portion of the front surface of the blade is beveled and provides a beveled plastic wear edge 46. A raised plastic wear bar 48 comprising a horizontal protuberance or tab of impact-resistant plastic, can extend integrally forwardly of the central portion of the beveled wear edge to further enhance the wear and longevity of the wear edge and child's snow blade. The wear bar can be aligned with and have the same span as the center rib. The wear bar span as the center rib, which is also referred to as a wear-resistant strip, cooperates with the wear edge to resist wear, as well as to help protect and enhance the useful life of the child's snow blade. The child's snow blade is designed and arranged for strength, longevity and durability, with or without wear bars.

Figure 3:
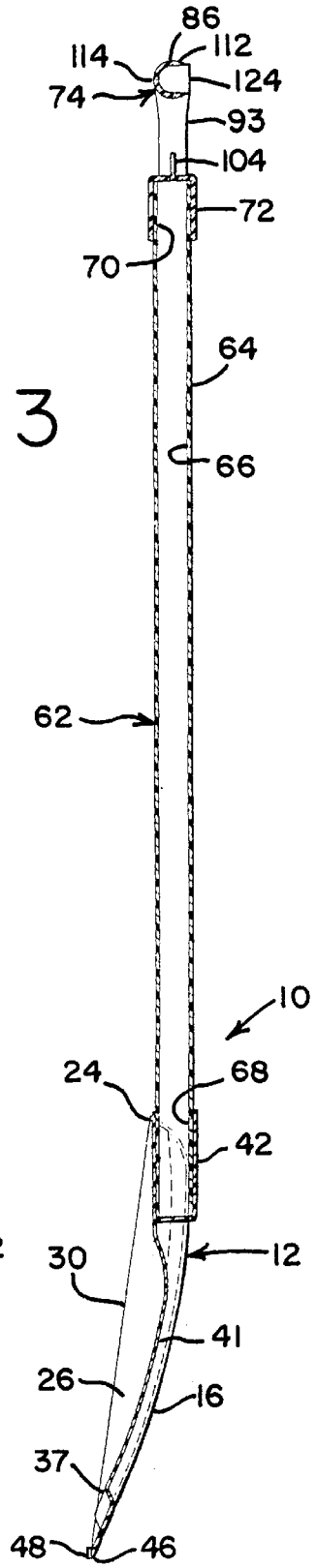
FIG. 3 is a cross-sectional view of the child's snow shovel taken substantially along line 3—3 of FIG. 2.

A flexible handle assembly 60 (FIGS. 1–4) is provided to grip the child's snow tool and maneuver, shovel and lift the blade. The flexible handle assembly has an elongated tubular, manually grippable shaft or shank 62 providing a straight child's handle. To decrease weight, the handle (shaft) can be hollow, annular and tubular. The handle can have a smooth or polished circular exterior surface 64 and an interior circular inner surface 66 (FIG. 3). The handle can comprise an extruded resinous tube or sheath of impact-resistant plastic, such as polyvinyl chloride (PVC), polypropylene or polyethylene. The tube can be semi-rigid, yet flexible and bendable enough to withstand impact forces, bending and torque associated with shoving, scraping and throwing snow. Child snow tools have been successfully fabricated by applicants with an overall height less than three feet and more specifically, less than 34.2 inches with a handle (shaft) length or height of two feet (24 inches).

The lower blade-connecting male end 68 of the handle telescopically fits and is positioned within and is coupled to the female socket (coupling) of the blade. The blade coupling (socket) closes and seals the lower blade-connecting end of the tubular handle. The upper handgrip-connecting male end 70 of the handle telescopically fits and is positioned within and is coupled to a female socket 72 of a ribbed, D-shaped, plastic ergonomic child's handgrip 74. The female socket, which is also referred to as handgrip coupling, provides a cap which covers and closes the upper end of the tubular handle. One or more wire or metal staples 76 and 77 or fasteners can securely staple, connect and fasten the upper handgrip-connecting end of the handle to the handgrip coupling (socket) of the child's snow tool.

The child's handgrip 74 (FIGS. 1–4) is specially shaped, arranged and constructed for comfort and to enhance gripping of the snow tool by children. Desirably, the child's handgrip further helps children shovel, lift, control and maneuver the blade and child's snow tool. The child's handgrip is connected to the upper end of the handle (shaft) at a location longitudinally (axially) opposite and spaced away from the blade. The handgrip is preferably molded of impact-resistant plastic, such as polyethylene or polypropylene.

The child's handgrip can have front and back portions 78 and 79 which are integrally connected along a mold parting line 80 or flange. The child's handgrip has an access opening 81 for comfortably receiving all five fingers of a child's hand. The opening is too small to comfortably receive all five fingers of an average man (adult male) or average women (adult female). Child's handgrips have been successfully molded by applicants with a horizontal span (width) slightly more than 4 inches and a vertical height of slightly more than 4.1 inches with an access opening having a horizontal span (width) slightly less than 3.2 inches and a vertical height of about 1.75 inches.

The child's handgrip can have bifurcated, V-shaped, flared, spread and slanted sides 82 and 84 which converge toward the handle (shaft) and are integrally connected to the sides of the handgrip coupling (socket). The sides of the child's handgrip can have an H-shaped cross-sectional configuration.

In the child's handgrip, a manually grippable crossbar or bight 86 (FIGS. 1 and 2) extends transversely across, laterally between and is integrally connected to the sides of the handgrip. The crossbar (bight) closes the upper diverging end of the spread sides of the D-shaped handgrip. Preferably, the crossbar and sides intersect each other with rounded finger-engageable corners 88 and 90. The comers are curved to comfortably receive the thumb of the child's hand to further facilitate gripping of the snow tool.

The sides of the child's handgrip can have raised side flanges 92–99 (FIGS. 2 and 4) comprising inner and outer converging ribs to enhance the structural strength of the child's handgrip. Each of the sides can have parallel front and back flanges comprising outer and inner flanges which extend integrally upwardly and downwardly from and are separated by flat or planar pads 100 and 102. The pads are spaced between and are integrally connected to the flanges. The pads and flanges cooperate with each other to provide further gripping surfaces.

Inner curved webs 104 and 106 (FIGS. 2 and 4) provide interior, arcuate, lateral ribs which extend between and integrally connect the inner flanges of the sides to the cap (socket) of the child's handgrip. Outer curved webs 108 and 110 provided exterior, arcuate, lateral ribs which extend between and integrally connect the outer flanges of the sides to the cap (socket) of the child's handgrip.

The crossbar (bight) of the child's handgrip has a manually grippable portion comprising a generally straight or planar, smooth upper surface 112 and a curved smooth or polished front face 114. The front face of the crossbar can be slightly convex in the crosswise (lateral) and downward directions and can have a bulging, rounded intermediate section 116 which complements the curvature of the child's curled fingers when grasping the handgrip to further facilitate gripping of the child's handgrip and snow tool.

Figure 4:
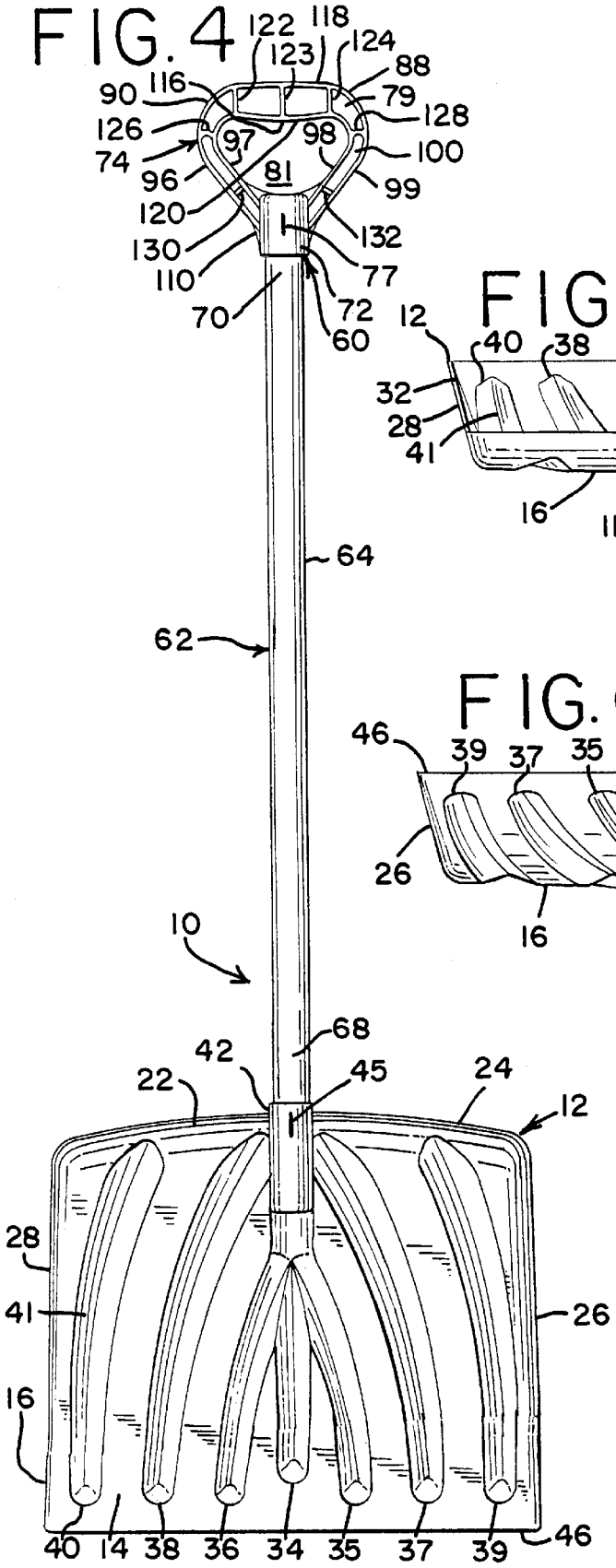
FIG. 4 is a back view of the child's snow shovel.
Figure 5:
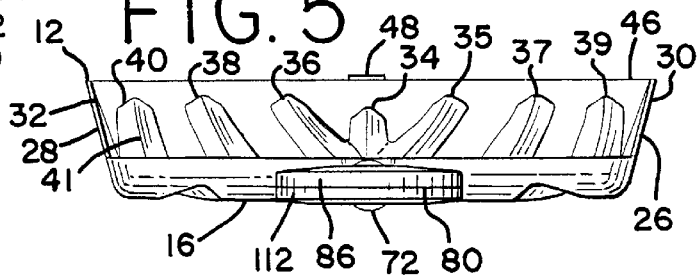
FIG. 5 is a top end view of the child's snow shovel.
Figure 6:
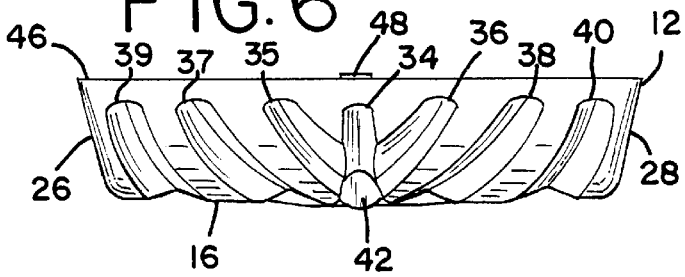
FIG. 6 is a bottom end view of the child's snow shovel.

As shown in FIG. 4, the back of the crossbar of the child's handgrip has downwardly extending and depending outer and inner crossbar flanges 118 and 120. Straight, parallel reinforcing crossbar ribs 122–124 can extend vertically between and integrally connect the crossbar flanges. The reinforcing crossbar ribs decrease the weight of the child's snow tool and enhance the structural strength and integrity of the child's handgrip. In the preferred embodiment, the crossbar ribs are parallel to the longitudinal axis of the tubular handle (shaft) and the middle, center or intermediate crossbar rib is in coaxial alignment and registration with the longitudinal axis of the handle (shaft). Desirably, the cross bar ribs comprise aliquotely, uniformly spaced, finger-gripping ribs to further facilitate gripping of the bight (crossbar) and child's snow tool.

Rounded, upwardly convex curved comer ribs 126 and 128 (FIG. 4) can extend between and integrally connect the back flanges of the rounded comers of the handgrip to further enhance the structural strength and integrity of the corners of the handgrip. Downwardly diverging, flared side ribs 130 and 132 can extend between and integrally connect the lower portions of the back flanges of the sides on the back of the child's handgrip in proximity to the handgrip coupling (socket). Advantageously, the side ribs, comer ribs and crossbar ribs cooperate with the crossbar and side flanges of the child's handgrip to enhance gripping for children. Furthermore, the side ribs, comer ribs, crossbar ribs and side flanges decrease the weight of the child's snow tool and enhance the structural strength of the child's handgrip.

Among the many advantages of the child's snow tool comprising the child's snow shovel are:

1. Better ability for children to shovel, lift and throw snow than conventional snow shovels.
2. Enhanced capability and flexibility than standard snow shovels for children.
3. Readily picks up and throws snow.
4. Superb performance.
5. Good snow removal.
6. Easy to assemble, store and ship.
7. Light weight.
8. Fun.
9. Attractive.
10. Safe.
11. Dependable.
12. Child friendly.
13. Environmental beneficial.
14. Convenient.
15. Sturdy.
16. Portable.
17. Comfortable.
18. Simple to use.
19. Efficient.
20. Inexpensive.
21. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A child's snow tool, comprising:

a snow blade;

a handle assembly comprising a plastic handle operatively connected to said snow blade and a handgrip operatively connected to said handle;

said plastic handle comprising an annular tubular shaft with a lower blade-connecting end and an upper handgrip-connecting end;

said snow blade having ribs and forming a socket for receiving the lower blade-connecting end of said annular tubular shaft;

said handgrip comprising a generally D-shaped plastic handgrip having a female socket for receiving the upper handgrip-connecting end of said annular tubular shaft, said handgrip having flared sides connected to said female socket and a crossbar extending between and connected to said flared sides, each of said flared sides having substantially parallel front and back flanges and a generally H-shaped cross-sectional configuration, said crossbar having a curved front face and a back with crossbar flanges, crossbar ribs extending between and connecting said crossbar flanges, and side ribs extending between and connecting the back flanges of said flared sides.

2. A child's snow tool in accordance with claim 1 wherein said snow blade comprises a plastic snow blade for shoveling, pushing or lifting snow.

3. A child's snow tool in accordance with claim 2 wherein said plastic snow blade is selected from the group consisting of a plastic shovel blade and a plastic scoop.

4. A child's snow tool in accordance with claim 1 wherein said annular tubular shaft comprises an extruded plastic tube comprising a plastic selected from the group consisting of polyvinyl chloride, polypropylene and polyethylene.

5. A child's snow tool in accordance with claim 1 wherein said annular tubular shaft consists essentially of a hollow plastic shaft.

6. A child's snow shovel, comprising:

a flexible plastic child's snow shovel blade for shoveling, lifting and throwing snow, said flexible plastic child's snow shovel blade having a concave front blade surface, a convex back blade surface, a lower portion providing a leading edge, and an upper portion providing a trailing edge, said leading edge comprising a beveled plastic wear edge, said blade having inverted generally V-shaped ridges projecting integrally forwardly from the front blade surface between said lower portion and said upper portion for facilitating shoveling and channeling of the snow towards the trailing edge of the upper portion of the front blade surface, said ridges comprising ribs with rounded apexes including a center rib, inboard ribs and outboard ribs, and said blade having a blade coupling defining a blade socket positioned in proximity to said trailing edge and in coaxial alignment with said center rib;

a lightweight plastic child's handle assembly for manually maneuvering said blade comprising a hollow flexible elongated shaft comprising an annular manually grippable shank providing a tubular handle consisting essentially of impact-resistant plastic, said handle having a lower blade-connecting end for telescopically fitting and positioning within said socket of said blade coupling and having an upper handgrip-connecting end; and a plastic generally D-shaped child's handgrip connected to said handle at a location spaced from said blade, said handle extending between and secured to said handgrip and said blade, said handgrip having a handgrip coupling defining a handgrip socket for telescopically receiving and securely engaging said upper handgrip-connecting end of said handle, said handgrip having flared sides integrally connected to said handgrip coupling and converging towards said handle, said handgrip having a bight providing a convex manually grippable crossbar extending between and integrally connecting said flared sides, said crossbar having a curved front face and a back with crossbar flanges and crossbar ribs extending between and connecting said crossbar flanges for facilitating gripping by children, and said handgrip having rounded corners intersecting said flared sides and said bight;

said bight cooperating with said flared sides to define a child's access opening for comfortably receiving a child's hand, and said flared sides having a substantially H-shaped cross-sectional configuration for enhancing gripping of the child's handgrip by children.

7. A child's snow shovel in accordance with claim 6 wherein:

said flared sides of said child's handgrip have side ribs for enhancing gripping of the handgrip by children.

8. A child's snow shovel in accordance with claim 6 wherein:

said plastic child's snow blade is selected from the group consisting of polyethylene and polypropylene;

said flexible handle consists essentially of impact-resistant plastic selected from the group consisting of polyvinyl chloride, polyethylene and polypropylene; and said child's handgrip comprises impact-resistant plastic selected from the group consisting of polyethylene and polypropylene.

9. A child's snow shovel in accordance with claim 6 wherein:

said flared sides of said child's handgrip have substantially front and back parallel flanges and substantially planar pads between said parallel front and back flanges for enhancing gripping of said handgrip by children; and said child's handgrip has webs comprising lateral ribs extending between and connecting said handgrip coupling to said parallel front and back flanges of said flared sides.

* * * * *